United States Patent [19]

Garcia

[11] 4,181,927

[45] Jan. 1, 1980

[54] CANDLE HOLDER

[76] Inventor: John A. M. Garcia, 1818 Hancock St., Los Angeles, Calif. 90031

[21] Appl. No.: 741,970

[22] Filed: Nov. 15, 1976

[51] Int. Cl.[2] ..... F21V 35/00; F21V 15/00

[52] U.S. Cl. ..... 362/163; 362/810; 431/291

[58] Field of Search ..... 431/289, 291; 362/161, 362/163, 180, 314, 810

[56] References Cited

U.S. PATENT DOCUMENTS

| | | | |
|---|---|---|---|
| 910,681 | 1/1909 | Herman | 362/180 |
| 2,214,991 | 9/1940 | Candy, Jr. | 362/161 |
| 2,621,503 | 12/1952 | Schaefer | 362/161 |
| 2,820,887 | 1/1958 | McInnis | 362/180 |
| 3,558,871 | 1/1971 | Rogers | 240/13 |

*Primary Examiner*—Samuel W. Engle
*Assistant Examiner*—Edward F. Miles
*Attorney, Agent, or Firm*—Bernard P. Drachlis

[57] ABSTRACT

A candle holder for candles formed from glass containers having wax and a wick therein. The candle is placed on a base which is relatively wide to provide stability. A cover is placed over the candle which partially covers the top opening of the candle. The cover is formed from a ring having a chimney extending upward from the inner diameter of the ring and a conical flange extending downward and outward from the outer diameter of the ring. The chimney has a plurality of holes spaced around its base. A pair of holding rods connect the cover to the base so that the candle is held between the cover and base to form a semi-rigid stable assembly.

The cover, which may be used separately from the base, functions to prevent air currents over the top of the candle from causing the flame to flicker and smoke the inside of the glass container. The cover also keeps heat contained in the candle to melt the wax evenly across its surface.

5 Claims, 8 Drawing Figures

CANDLE HOLDER

SUMMARY OF THE INVENTION

This invention relates to improvements in covers and holders for candles formed by pouring wax in a glass container or bottle and having a wick therein. When the wick of such a candle is lit it melts the wax surrounding the wick and the molten wax flows up the wick and is burned by the flame. This type of candle is usually formed in a tall slender cylindrical container. Such candles are well known in the art.

When air flows past the top of the glass container of the type of candle described above, it tends to cause the wick to flicker which can be distracting to the person viewing the candle. The flickering also causes the inside of the glass container to become smokey from the smoke of the flame. This type of candle can be knocked over fairly easily if it is accidentally hit or bumped.

The present invention overcomes these disadvantages by providing a cover for the glass candle container which covers a portion of the opening of the glass container to keep heat contained within the candle. The cover also has a cylindrical chimney to allow hot air to escape from the candle. Holes are provided at the base of the chimney to provide fresh air to the candle to allow it to continue to burn. A conical flange extends outward and downward from the cover.

It has been found that the use of the cover as provided by the present invention allows the candle to burn without flickering and without smoking the inside of the glass container. It also helps to keep heat contained in the candle to more evenly melt the wax in the glass container and prevents indentations in the wax from uneven melting near the wick.

A wide stable heavy base assembly is also provided which holds the glass bottled candle. Holding rods connect the cover to the base assembly to form a semi-rigid unit which makes the total assembly much more stable.

DESCRIPTION OF THE PREFERRED EMBODIMENTS

A candle 10 is formed from a tall cylindrical glass bottle containing wax and a wick. This type of candle is well known in the art. One type of candle of this design is approximately 9 inches tall and between 2½ and 3 inches in diameter.

Figure 1:
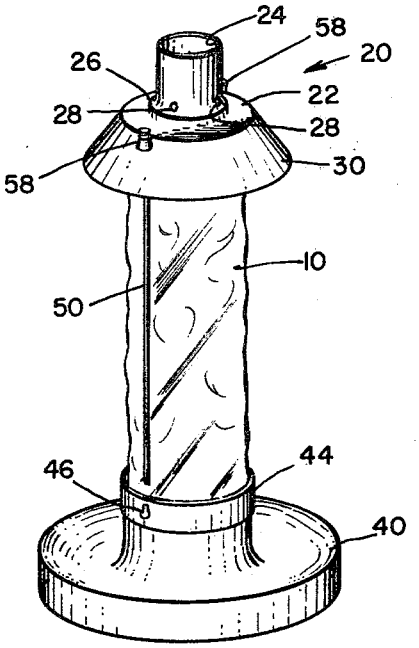
FIG. 1 is a perspective view of one embodiment of the present invention.
Figure 2:
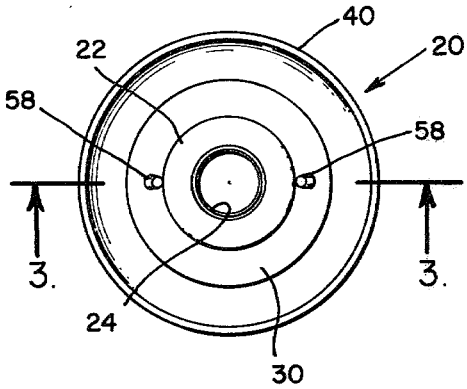
FIG. 2 is a top view of the embodiment shown in FIG. 1.
Figure 3:
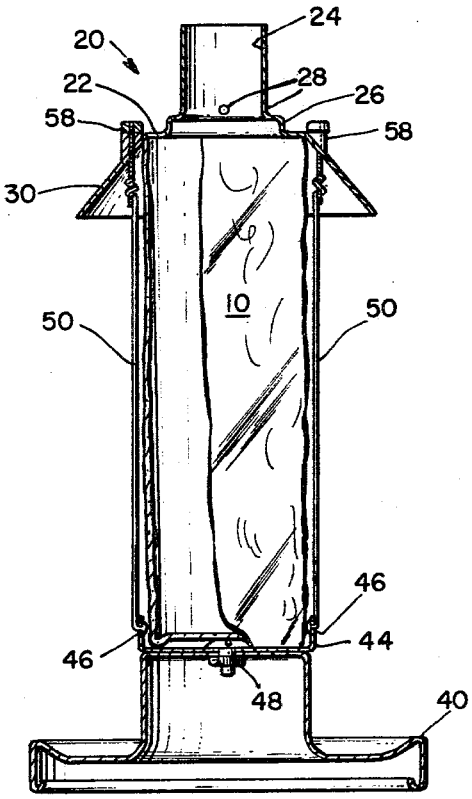
FIG. 3 is an enlarged sectional view of the embodiment shown in FIG. 1, taken along the line 3—3 of FIG. 2.

Referring to FIGS. 1 and 3 a cover 20 is shown over the candle 10. The cover 20 has a flat ring 22 which partially covers the opening of the candle 10. A cylindrical chimney 24 extends upward from the inside diameter of the ring 22. A plurality of holes 28 are spaced around the base of the chimney 24. The cover 20 may include a circular shoulder 26 where the base of the chimney 24 meets the ring 22. The circular shoulder 26 is adapted to allow the cover 20 to be used with candles that have a narrower top opening than the standard candles described above. A concial flange 30 extends outward and downward from the outer diameter of the ring 22.

The cover 20 may be made from any rigid or semi-rigid heat resistant material, preferably a metal. The ring 22 and the chimney 24 function to reduce the effects of air drafts over the top of the candle on the flame inside the candle. This prevents flickering and smoking of the inside glass of the candle 10. The partial covering of the opening of the candle 10 by the ring 22 also helps to evenly distribute the heat inside the candle 10 so that the wax melts evenly across its surface. The holes 28 at the base of the chimney 24 supply fresh air to the candle to allow the flame to continue to burn. The flange 30 also helps to keep the heat evenly distributed inside the candle 10 but it is mainly decorative. For a typical candle having a diameter of between 2½ and 3 inches, it has been found that a chimney diameter of 1½ inches and a chimney height of approximately 2 inches is preferable. It has also been found that four holes 28 of a diameter of approximately ½ to ⅝ of an inch are preferable.

The cover 20 may be used alone with the candle 10 to provide the functions described above. The cover 20 may also be used with the base assembly to be described below. When it is used with that assembly, two holes opposite each other are provided in the conical flange 30 adjacent to its connection with the ring 22.

A base 40 is provided which is wide and heavy to provide stability to the completed assembly. The base 40 may be of any preferred shape or size that is convenient for the use to which the candle will be put. The base shown in FIGS. 1 and 3 has a raised pedestal in the center surrounded by a relatively wide and flat circular portion having a concave top surface. A cup 44 is provided and is formed from a circular base and a cylindrical wall. The shape of the cup 44 is determined by the shape of the candle. Two holes 46 are provided on opposite sides of the wall of the cup 44. The holes 46 are pear shaped and formed from two over-lapping holes of different diameters with the narrower diameter being near the top of the cup 44. A fastener 48 connects the cup 44 to the base 40. The fastener 48 may be any convenient type of fastening device such as a nut and bolt.

Figure 4:
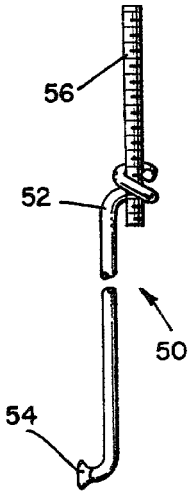
FIG. 4 is a holding rod used with the present invention.

A pair of holding rods 50 are provided. The details of the holding rods 50 are shown in FIG. 4. The holding rods 50 have a long slender portion 52 and a right angle bend near one end. Immediately past the right angle bend there is a circular flange portion 54. At the opposite end of the holding rod 50, a threaded member 56 is attached. The attachment of the threaded member 56 may be by any convenient method depending upon the material used. In the preferred embodiment, the holding rod 50 and the threaded member 56 are metal and it has been found that it is preferable to wrap the slender portion 52 around the threaded member 56 as a means of attachment as shown in FIG. 4. However, if desired the method of attachment may be by welding. It should be noted that if it is convenient the threads may be applied directly to the straight end of the holding rod 50. In the preferred embodiment, the holding rod 50 is made from a bicycle wheel spoke and it is more convenient to attach a threaded member 56 than to attempt to thread the straight end of the bicycle wheel spoke.

After the cup 44 is attached to the base 40, the candle 10 is placed in the cup 44. The flanged ends 54 of the pair of holding rods 50 are then inserted in the holes 46. The cover 20 is placed over the candle 10 with the threaded portion 56 of the holding rods 50 inserted through the holes in the conical flange 30 of the cover 20. A pair of threaded holding nuts 58 are then screwed onto the threaded portion 56 of the holding rods 50 to hold the cover 20 securely down on the candle 10. When the holding nuts 58 have been tightened the completed assembly forms a semi-rigid structure which is very stable.

The holes 46 are formed from two over-lapping holes of different diameters. The smaller diameter hole is nearer the top of the wall of the cup 44. The larger diameter hole is larger than the flange portion 54 of the holding rod 50 and the smaller diameter hole is smaller than the flange portion 54 of the holding rod 50.

When it is desired to insert a new candle 10 into the assembly, one of the holding nuts 58 is loosened but not completely removed. The holding rod is then removed from the hole 46 and the cover 20 is lifted from the candle 10. The candle may then be removed from the cup 44 and a new candle placed therein. The holding rod 50 is then reinserted in the hole 46 and the holding nut is tightened.

Figure 5:
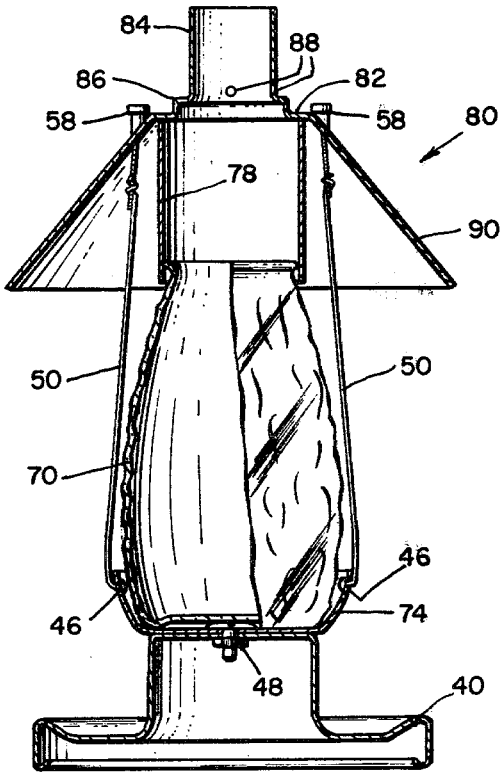
FIG. 5 is a side elevational view of a second embodiment of the present invention with parts broken away and parts taken in section.

A second embodiment of the invention is shown in FIG. 5. A candle 70 with an oval shape is shown. A base 40 is used which may be identical to the base shown in FIGS. 1 and 3. A cup 74 is provided which has a flat circular bottom and conical shaped walls to adapt to the shape of the candle 70. A pair of holes are provided in the walls of the cup 74. The holes will have a shape identical with the holes 46 shown in FIG. 1. The typical oval candle 70 as shown in FIG. 5 is shorter than the typical cylindrical candle 10 shown in FIGS. 1 and 3. To adjust for the height difference and allow for the interchangeable use of parts, an extension cylinder 78 is placed over the top of the candle 70. The extension cylinder 78 has a height which will bring the total height of the candle 70 and the extension cylinder 78 to approximately the same height as the typical cylindrical candle 10. The cylinder 78 may be made from any convenient rigid heat resistance material. The cylinder 78 is preferably made from a metal.

A cover 80 is placed over the extension cylinder 78. The cover 80 is formed from a ring 82 and a cylindrical chimney 84. The chimney 84 has a plurality of holes 88 around its base. The cover 80 may include a circular shoulder 86 forming the connection between the inner diameter of the ring 82 and the base of the chimney 84. The cover 80 also includes a conical flange 90 extending outward and downward from the outer diameter of the ring 82. The flange 90 may be of any preferred size and angle to give the most esthetic looks to the completed assembly. This of course, would depend upon the particular shape of the candle 70. In the embodiment shown in FIG. 5 the flange 90 has a greater function for distributing and containing the heat from the candle 70 evenly over the top surface of the wax to provide even melting of the wax and prevent an indentation in the wax as the flame melts the candle near the wick.

It has been found through experimentation that the ring, shoulder, chimney and the holes in the chimney for the cover 80 shown in FIG. 5, may have the same dimensions as described above for the cover 20 shown in FIGS. 1 and 3. The use of the same dimensions facilitates the interchangeable use of covers for various candle shapes. For example, the cover shown in FIG. 5 could be used with the candle shape shown in FIG. 1 if that is desired.

A pair of holding rods 50 identical to those shown in FIGS. 1, 3 and 4 are provided to hold the cover 80 to the cup 74 to make the assembled unit semi-rigid and stable.

Figure 6:
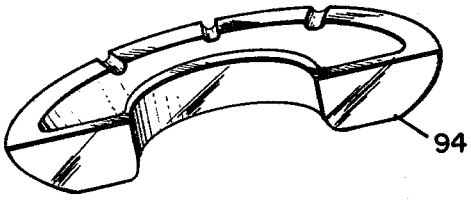
FIG. 6 is an ash tray which may be used with the present invention.
Figure 7:
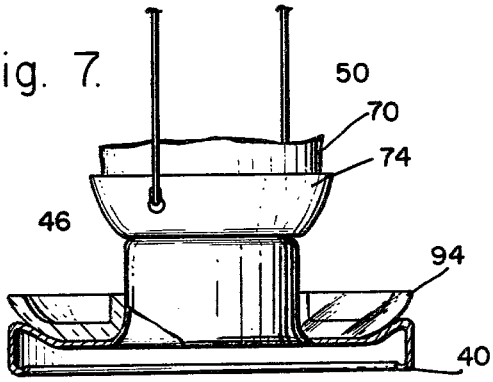
FIG. 7 shows an ash tray in use in combination with one embodiment of the present invention.

For certain types of use, especially in restaurants, for example, ashtrays 94 as shown in FIGS. 6 and 7 may be placed in the concave portion of the base 40 to provide a convenient place for smokers to place their cigarette ashes. While the ashtrays 94 are shown in use with the embodiment of FIG. 5, it should be clear that the ashtrays 94 could just as well be used with the embodiment shown in FIGS. 1 and 3.

Figure 8:
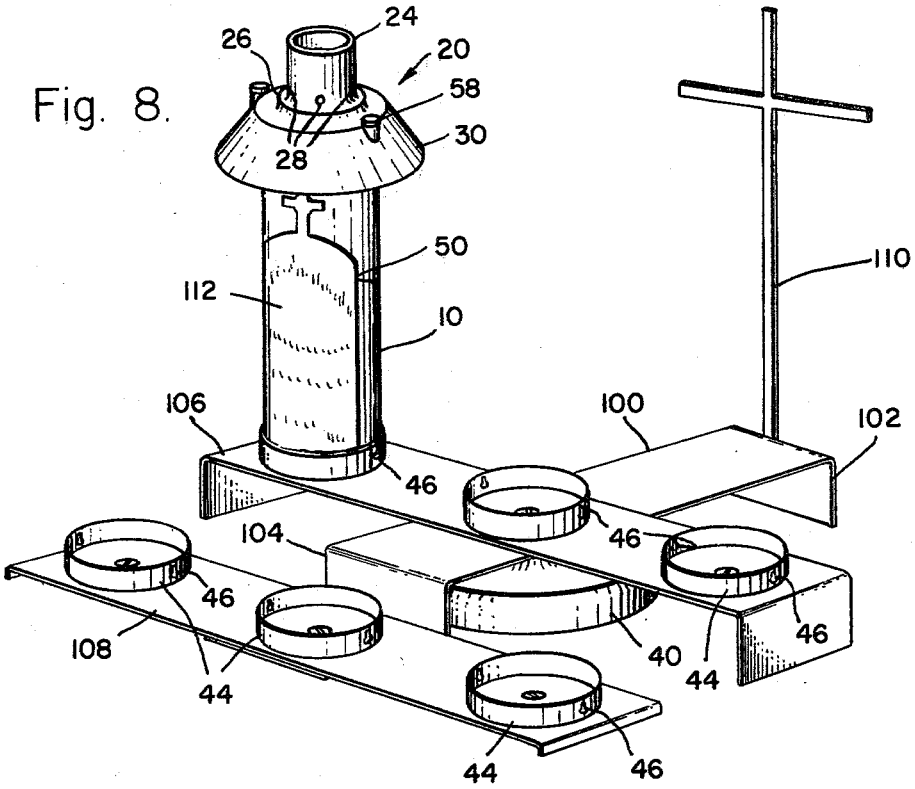
FIG. 8 shows an altar assembly using the candle holders of the present invention.

Besides use of the candles described in the preferred embodiments in restaurants and other public places, such candles are also frequently used for religious purposes both in churches and in private homes. Persons sometimes burn a single candle or groups of candles in their homes as part of their religious practices. The candle holders and covers of the present invention can of course, be used for such purposes. Persons sometimes use the candles in their homes as part of a religious altar. An altar device using the candle holders of the present invention is shown in FIG. 8. A base 40 is used to which is attached a longitudinal member 100. The longitudinal member 100 is formed from a flat strip of rigid material approximately 3 inches wide. The longitudinal member 100 has a downward facing right angle flange 102 at the rear end of the longitudinal member and a downward step 104 near the front of the longitudinal member. The lower portion of the right angle flange 102 is approximately in the same place as the lower edge of the base 40. A first cross member 105 crosses the longitudinal member 100 at right angles over the base 40. The first cross member 105 has a downward facing right angle flange at each end. The lower edge of each right angle flange of the first cross member 106 is in approximately the same plane as the lower edge of the base 40. A second cross member 108 is attached to the lower portion of the step 104 of the longitudinal member 100. The second cross member 108 has a downward facing right angle flange at each end. The lower edge of each right angle flange of the second cross member 108 is in approximately the same plane as the lower edge of the base 40. The first and second cross members are made from the same material as the longitudinal member 100. A plurality of cups 44 are attached to the first and second cross members. Any convenient number of cups 44 may be used. The embodiment of FIG. 8 shows three cups on each cross member. The cups may be attached to the cross members by any convenient method of attachment such as nuts and bolts. It should be noted that the method of attaching the center cup on the first cross member 106 is also used to attach the first cross member 106 to the longitudinal member 100 and to attach both of these members to the base 40. Similarly the attachment used to attach the center cups on the second cross member 108 also attaches the second cross member 108 to the longitudinal member 100.

As noted above, the lower surface of the right angle flanges of the first cross member 106, the second cross member 108 and the right angle flange 102 of the longitudinal member 100 are in approximately the same plane as the lower surface of the base 40 to help provide stability to the completed structure when it is resting on a flat surface.

An upright member 110 is shown attached to the longitudinal member 100 near the right angle flange 102 to provide a method of securing a religious symbol or article to the structure. The upright member 110 may be attached by an convenient method. The completed structure shown in FIG. 8 forms a simple altar which may be used in a person's home for burning candles for religious purposes. One such candle is shown located on the first cross member 106. The candle 10 and the cover 20 would be identical to those described above with reference to FIGS. 1 and 3. The holding rods 50 would be attached to securably hold the candle in place. Typically, a plurality of candles would be used on the altar structure and each would have a cover 20 held in place with holding rods 50. By using the cover 20 and the holding rods 50 for each of the candles placed on the altar structure, the complete unit is semi-rigid and stable and provides greater safety in using the candles in the home.

Many times the candles used for religious purposes have religious words or pictures placed directly on the glass bottle of the candle 10 or have such words or pictures attached to the candle 10. This is shown generally as 112 on the candle attached to the altar structure of FIG. 8.

What is claimed is:

1. A candle holder for a candle comprising a container having fuel and a wick therein, said candle holder having a cover, said cover comprising:

a ring;

a chimney extending upward from said ring, said chimney having a plurality of holes spaced around its base;

a conical flange mounted on said ring and extending downward and outward therefrom;

a base assembly, the candle being mounted on said base assembly for holding the candle; and holding means for detachable interconnection of said cover and said base assembly for detachably interconnecting said base assembly and said cover whereby the candle is detachably held between said base assembly and said cover, said holding means comprising a hole in said cover and a hole in said base assembly, a holding rod having a flange on one end thereof and being detachably engaged in one of said holes, the end of said holding rod opposite said flange extending through the other of said holes; a nut engaged on the end of said holding rod opposite said flange portion, said nut engaging adjacent said hold opposite said hold engaged by said flange so that tightening said nut tightens said cover with respect to said base assembly.

2. A candle holder as claimed in claim 1, wherein said base assembly comprises:

a base having a raised pedestal surrounded by a relatively wide and flat circular portion having a concave top surface;

a cup having the shape of the bottom of the glass container of the candle; and fastening means for attaching said cup to the raised pedestal of said base.

3. A candle holder as claimed in claim 1, wherein said cover comprises:

a ring having an inner and outer diameter;

a chimney extending upward from the inner diameter of said ring, the chimney having a plurality of holes spaced around its base; and wherein said conical flange is secured in the outer diameter of said ring.

4. The candle holder of claim 1 wherein said holding rod has a circular flange thereon and one of said holes is a pear-shaped hole having a large portion for passing said circular flange on said holding rod and a small portion for retaining said circular flange so that said holding rod can be detachably engaged in said pear-shaped hole.

5. The candle holder of claim 1 wherein there are two of said holding rods and two sets of said holes so that said cover is detachably retained with respect to said base assembly by said two holding rods.

* * * * *